United States Patent [19]

Steinlein

[11] Patent Number: 4,846,365

[45] Date of Patent: Jul. 11, 1989

[54] PLASTIC STACKABLE BOTTLE CASE

[75] Inventor: Rudolf F. Steinlein, Munchen, Fed. Rep. of Germany

[73] Assignee: Alexander Schoeller & Co., Ag., Volketswil/Schwerzenbach, Switzerland

[21] Appl. No.: 83,772

[22] Filed: Oct. 11, 1979

Related U.S. Application Data

[63] Continuation of Ser. No. 896,505, Apr. 1, 1978, abandoned.

[30] Foreign Application Priority Data

Apr. 22, 1977 [DE] Fed. Rep. of Germany ..... 27180672

[51] Int. Cl.[4] ..... B65D 1/24

[52] U.S. Cl. ..... 220/21; 206/203; 206/510

[58] Field of Search ..... 220/21, 94 A; 206/203, 206/510

[56] References Cited

U.S. PATENT DOCUMENTS

| | | | |
|---|---|---|---|
| 3,363,802 | 1/1968 | Cornelius | 206/203 |
| 3,376,998 | 4/1968 | Cornelius | 206/203 |
| 3,628,684 | 12/1971 | Sere | 220/21 |
| 3,892,328 | 7/1975 | Steenbergen | 220/21 |
| 3,991,879 | 11/1976 | Hirotq | 206/510 |
| 3,998,327 | 12/1976 | Box | 220/21 |

FOREIGN PATENT DOCUMENTS

| | | | |
|---|---|---|---|
| 2141618 | 3/1972 | Fed. Rep. of Germany | 206/203 |
| 2213149 | 9/1972 | Fed. Rep. of Germany | 220/21 |
| 7315492 | 4/1973 | Fed. Rep. of Germany . | |
| 2255316 | 5/1974 | Fed. Rep. of Germany . | |
| 1540364 | 8/1968 | France | 220/21 |
| 760510 | 8/1976 | Sweden . | |
| 567968 | 10/1975 | Switzerland | 220/21 |
| 1075661 | 7/1967 | United Kingdom | 220/21 |
| 1183325 | 3/1970 | United Kingdom | 220/21 |

*Primary Examiner*—George E. Lowrance
*Attorney, Agent, or Firm*—Helfgott & Karas

[57] ABSTRACT

The interior of the case is divided by compartmenting walls into a plurality of bottle-receiving compartments and also a central compartment which is not suited for receiving bottles and is elongated. The compartments are hexagonal. At each end of the central compartment there is a Y-intersection of three compartmenting walls. The compartmenting walls are extended upwards at these two intersections at each end of the central compartment and tapered together as they rise. Across the top of the central compartment and attached to the shanks formed by the extensions of the compartmenting wall intersections is a central handle for carrying the case. The handle shanks thus do not require space in the case in addition to the space already taken up by the compartmenting walls, and at the same time provide guide surfaces for the bottles being inserted into the compartments surrounding the end regions of the central compartment. This greatly facilitates machine loading of the case with bottles. The case also is provided with several other features which facilitate handling. A spacing of the receiving compartments away from the side wall and an inner contouring of the side wall handles permits firmer holding by mechanical tongs and to reinforces against sideways pressure. Bottom support ribs are arranged for optimum load support. Special corner depressions at the top corners accomodate the bottom support rib arrangement of a similar case when stacked on top.

3 Claims, 8 Drawing Sheets

PLASTIC STACKABLE BOTTLE CASE

This is a continuation of application Ser. No. 896,505, filed Apr. 17, 1978 now abandoned.

BACKGROUND OF THE INVENTION

The present invention relates to stackable bottle cases of plastic which are divided inside into compartments for receiving the bottles and which have a handle extending across only a portion of the cross-sectional dimension, within the confines of the case, and raised above the compartmenting.

In a known bottle case of this type (such as described in the German Fed. Rep. Pat. No. 22 55 316, to which may also be compared similar structures described in the Swedish design application 76-0510 published Aug. 22, 1976) the compartments are designed to receive two parallel rows of bottles. The compartments accordingly form two adjacent rows of at least approximately square compartments. Between these rows there is provided a greater spacing than is provided between the compartments of one of the rows. Within this spacing region a bow-shaped handle rises from two support columns. The two compartment rows extend, as does the bow-shaped handle, in the lengthwise direction of the bottle case. In this way, a relatively large amount of room between the rows is lost.

It is also known (see for example the German Fed. Rep. Gebrauchsmuster 73 15 492) to have a carrying handle extend transversely between the two longitudinal sides of the case in such a way that two bottle rows extending longitudinally in the bottle cases are each interrupted by the width of the carrying handle. This arrangement also requires relatively much space in a stackable bottle case of plastic.

At any rate, if it is desired to make a bottle case with a central carrying handle, the handle must either be arranged low or be able to more or less fit into the dead space of the underpart of another case stacked thereon.

Such bottle cases with a central handle are of interest particularly, but nut exclusively, for so-called Minicases. These accept the same number of bottles, or somewhat fewer, than a half of a normal bottle case of normal size and permit palletizing and transport just as do the normal bottle cases. Their weight, together with the received bottles, is usually measured so that a housewife can carry the filled bottle case by the central carrying handle without too much exertion.

It is an object of the invention to provide a bottle case of this sort with a better use of space than in the above-described known bottle cases.

GENERAL DISCUSSION OF THE INVENTION

The novel bottle case in accordance with the present invention has a centrally located compartment which is surrounded by bottle receiving compartments and which has a handle extending over the central compartment. The handle is fixed at both ends to extensions of compartment walls where the walls intersect. Such an arrangement of the handle facilitates machine loading of the case with bottles.

The invention is based upon the realization that in general the space which is required for arrangement of the handle with a central compartment not capable of receiving a bottle is smaller than the corresponding dead space needed between bottle receiving individual compartments of the known cases described above.

Moreover, it has been found that while on the one hand much-used bottle case norms prescribe an even number of bottles to be received, the densest spatial arrangements of compartments for receiving bottles nevertheless receive uneven numbers. In such a situation the space needed for the extra compartment is immediately available for arrangement of the handle.

A simple integral profile of the handle together with the other bottle case results when at least one carrying shank of the handle is designed as an extension of the compartmentizing. An especially stable structure results when the carrying shanks form an extension of an intersection point region of the compartmentizing between the central compartment and a neighboring compartment for receipt of a bottle.

Preferably, the central compartment is designed to be open at the bottom. This not only prevents an accumulation of debris in the central compartment, but also simplifies the mold releasing of an injection molded plastic bottle case. However, one can also, for a particular instance, afterward provide the central compartment with a removable or non-removable bottom, for instance by later welding, when for instance the central compartment is intended as a container for articles such as advertising material.

Preferably the central compartment and the compartments for receiving bottles form compartments which are in rows running parallel in the direction of a width dimension of the bottle case in which the compartments of neighboring rows are arranged off-set to fill in intervening spaces. Here one can in the simplest limiting situation in which there are two compartments at each end and to either side of a central row of three compartments, including the center compartment in the sense of the invention, store in the minimum space an even number of bottles, namely six.

By departing from the basic geometrical design of the compartments as essentially square, one can improve substantially the compactness of the bottle case structure. This is especially true when the central compartment and at least the surrounding and immediately adjacent compartments for receiving bottles have a partially honeycombed or at least partially honeycombed opening crosssection. An only partly honeycombed opening cross-section is considered especially for the edge regions of the bottle case.

In all these types with compartment rows off-set with respect to each other to fill in the spaces, one can as desired arrange the compartments in mirror symmetry with respect to at least one mirror symmetry plane of the bottle case, so that in automatic handling (insertion or removal) of bottles there is invariance with respect to the orientation direction of the bottle case.

The packing density of the case can be further increased if the central compartment has a smaller width dimension than the corresponding width dimension of the compartments for receiving bottles. In this way space can again be saved by moving closer to the central compartment those compartments for receiving bottles which are adjacent the longitudinal side of the central compartment. This provides additional clearance for automatic case handling clamps to reach into the case to grasp the sides and makes it possible to construct the side wall more advantageously.

The elongated central compartment can alternatively have a greater width dimension than the corresponding width dimension of the compartments for receiving bottles, and the handle can then extend along this greater width dimension.

Stackable bottle cases are stacked not only with one case directly upon another case. There is also known the interconnecting staggered stacking for secure transport. For this, for example, one bottle case is stacked across a half, a third, or other section of a bottle case situated under it.

In general, for the type of case involved here, it is a condition for normal stacking of the case that the bottle case has a bottle-supporting bottom support rib arrangement which in the stacked condition extends into the upper case opening of the case beneath. For staggered stacking, the cases of the type in question are provided on their undersides with lengthwise and crosswise channel-like depressions in the support ribs with a depth which is the depth to which the bottom of the case is to extend into the lower one. The channel-like depressions divide the bottom support rib arrangement into individual equally-sized sections.

With this arrangement there is presented the problem of assuring crosswise stability of the bottle case for clamp palletizing.

For this purpose there is provided in accordance with the invention that at least one support reinforcement rib which extends in the bottom support rib arrangement between the lengthwise sides of the bottle case.

Such a support reinforcement rib can be eliminated if the supporting effect can be assured by the dividing walls of the compartments themselves. If, however, these compartments do not have any substantially straight compartment walls joining together the lengthwise walls of the bottle case, as is preferably provided in accordance with the present invention, then the required crosswise stability is achieved by means of at least one supplementary support reinforcement rib within the rib arrangement of the bottom.

Since the bottle case is particularly weak in the region of the crosswise extending channel-like depressions of the bottom rib arrangement, it is recommended that at the bottom support ribs be located closely adjacent the edge of each of the channel-like depressions of the bottom support rib arrangement.

In particular, a bottle case with a handle in accordance with the invention can combine in an optimal way the favorable handling characteristics and the compact space utilization and ruggedness for automatic handling.

In order to provide the maximum vertical support at the corners of the case, the channel-like depressions have a nearly right angled sharply rounded contour at the corners, so that corner wall overhang at the bottom corners is lessened. On the other hand, the bottles which are to be received by the bottle case are generally strongly rounded and thus do not require a particularly sharp-angled rounding of the bottle case in the corner region of the inner bottle case walls. On the contrary, a greater rounding with a greater radius is preferred there for stability reasons. In stacking of a bottle case immediately on the case thereunder with alignment of the side walls, one can in a given situation design the corners of the bottom support rib sections defined by the channels which are located on the underside of the case to be rounded in the same way as the inner wall surfaces of the bottle case itself, so that no difficulties are encountered in stacking. However, in order to combine the desired sharper corner condition of the bottom support rib sections with the requirements of staggered stacking capability, there is provided in accordance with the invention a corner depression in each of the upper inner corner wall surfaces of the bottle case and into which fit the relatively angular or sharply rounded corners of the bottom support rib sections of the underside of the next higher bottle case when the bottle cases are stacked on each other in a staggered manner. This corner depression feature is advantageous in bottle cases whether or not they have a central handle.

In the downward direction the corner depression can be always, and preferably, be rounded in cross-section as it joins the larger radius of curvature rounded inner wall regions of the bottle case corners. This not only has the advantage of eliminating dirt-catching steps, but also can be helpful in the staggered stacking arrangement of the bottle cases for transport securing arrangements.

For stability reasons, it is common to make the corner side walls of the bottle case double-walled. Thereby one can form the corner depression simply in the molding in that there is provided a constant wall thickness recessed inner wall of the double walled design of the bottle case corner.

In automatic handling, bottle cases are not held by central handle, whether they are with or without a handle or with or without cross-stacking capability, but are held rather by either a clamping device or a gripper. These grippers can be provided individually, especially for greater lengths, or in groups, such as in pairs. Thereby one can adjust as desired the arrangement of the grippers relative to each other and to the bottle case.

In order to make it possible that the bottle case can be reliably held by grippers of a transporting device reaching over the bottle case wall without danger of slippage even with greater loading, in the least limiting situation with the simultaneous holding of two adjacent bottle cases, there is provided in the upper region of the inner wall surface of the bottle case in accordance with the invention at least one profiled contact surface along the case length wall and/or front side wall. With grippers arranged in pairs, one can thereby, for example, provide profiled contact surfaces two at a time to both sides of the side walls and/or the front side wall of the case. For a given situation, there can also be provided in addition a central grasper at an additional central contact surface and corresponding further numbers of contact surfaces for symmetrically grasping graspers. A number of possible profiles are feasible, such as for example spaced ridges, wavey lines, nubs, fishbone arrangements, purely roughed surfaces, and in some instances additional coverings, etc.

For reasons of weight symmetry, the profiled contact surfaces are suitably arranged symmetrical to the middle of the sides of the bottle case. This is true also when one has a three part grasper. One can, however, also for example provide a continuous contact strip extending over the entire length of the bottle case.

If a central handle is provided in the sense of the invention, then for reasons of space, to give the grasper freedom of movement, it is suitable to have at least one profiled contact surface formed or arranged at least at the side walls of the bottle case parallel with the handle. Also in the lenthening of the handle there is enough room available for the reaching in of the grasper, since the handle need extend essentially only over the central compartment.

The invention is described in more detail in the following with schematic drawings and in connection with an embodiment.

DESCRIPTION OF A PREFERRED EMBODIMENT

Figure 1:
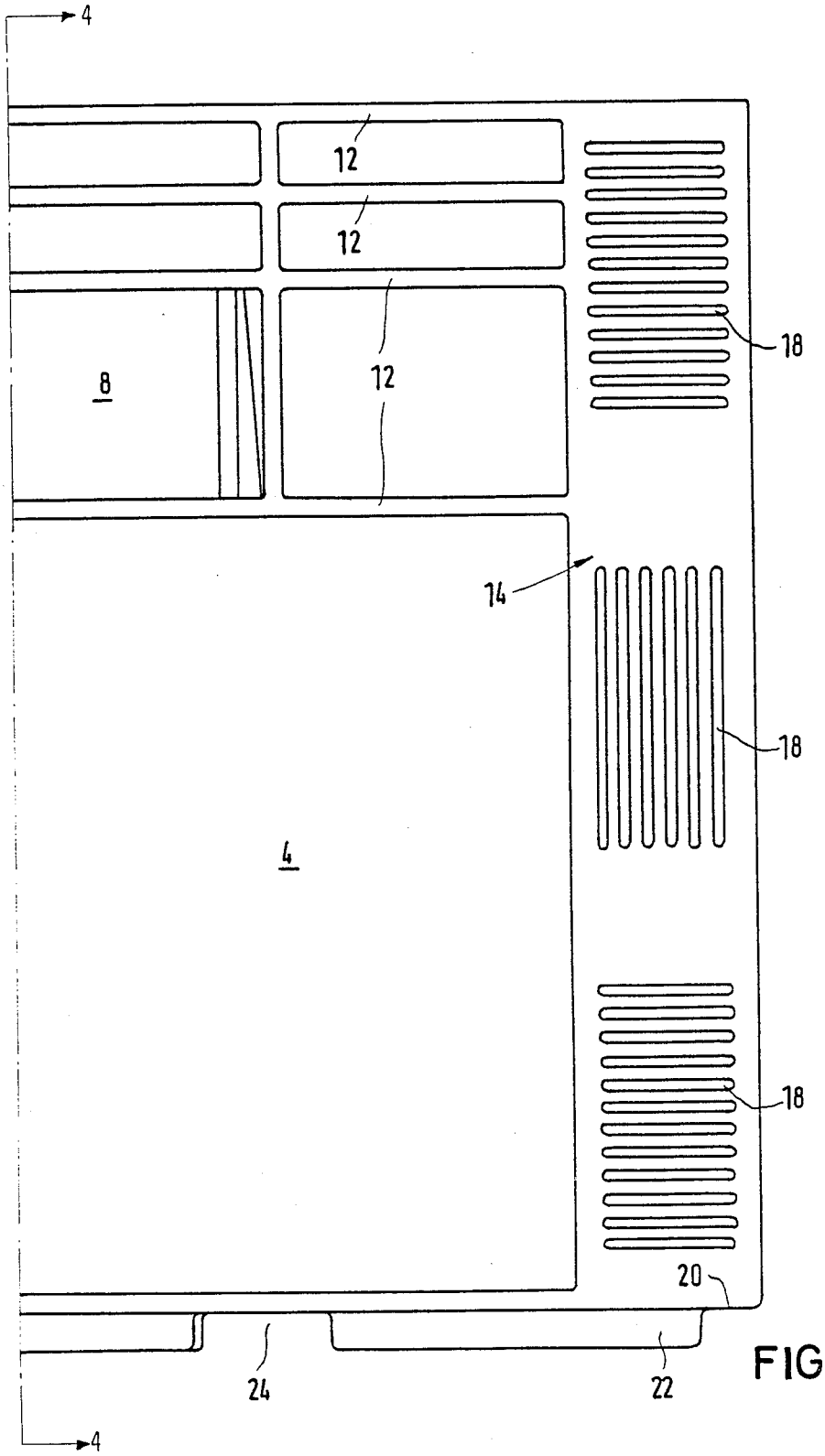
FIG. 1 is a partial side elevation of a stackable bottle case in accordance with the invention.
Figure 2:
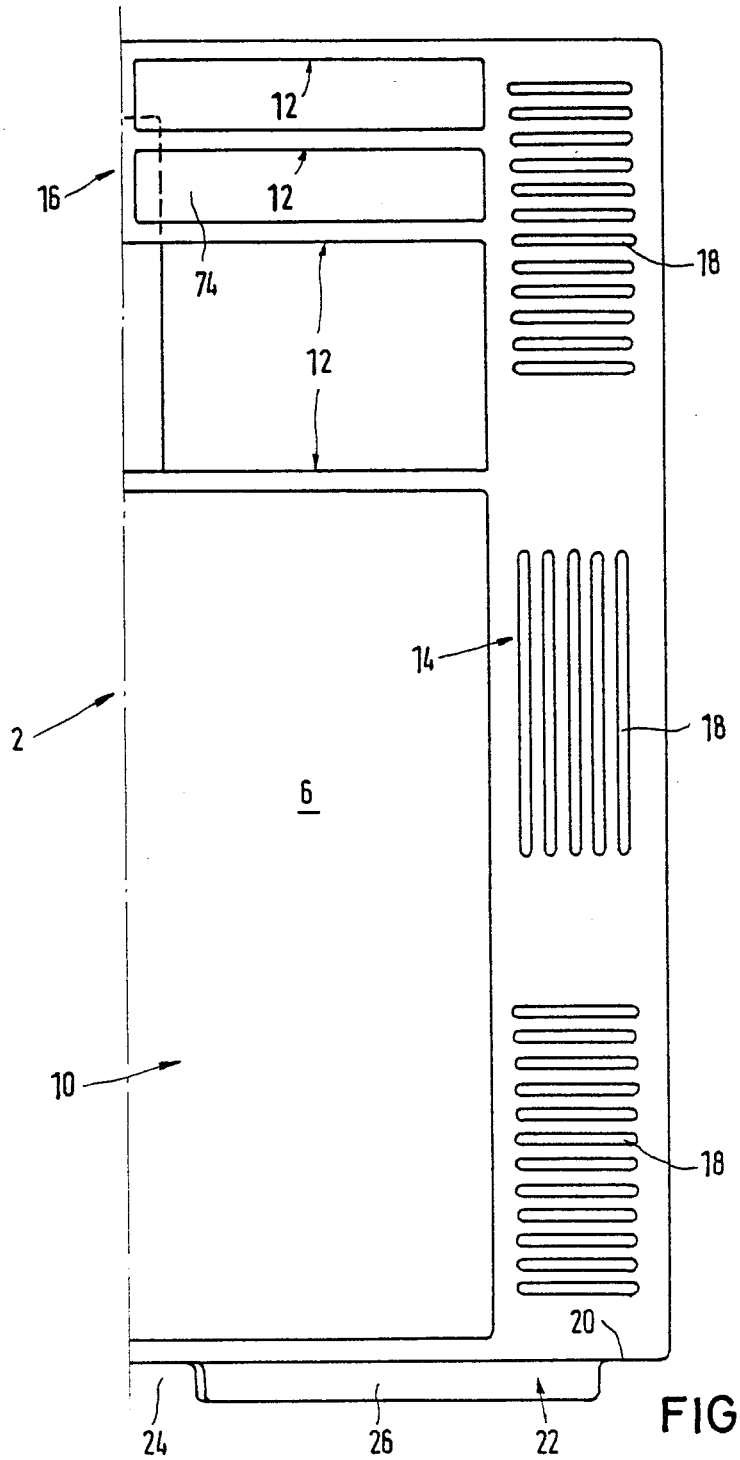
FIG. 2 is a partial end elevation of the bottle case of FIG. 1.
Figure 3:
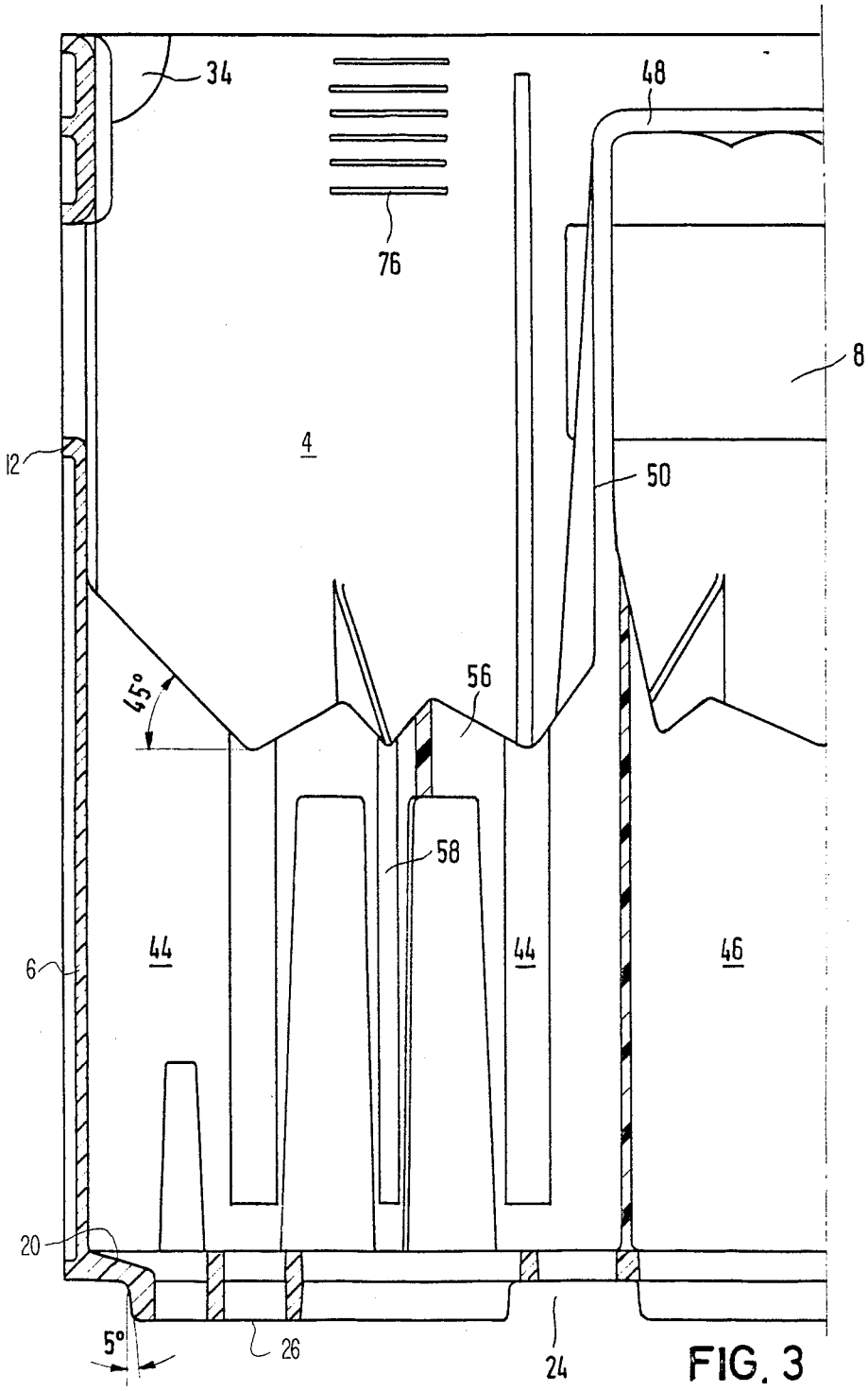
FIG. 3 is a partial side elevation in partial longitudinal section of the bottle case along line 3—3 of FIG. 5.
Figure 4:
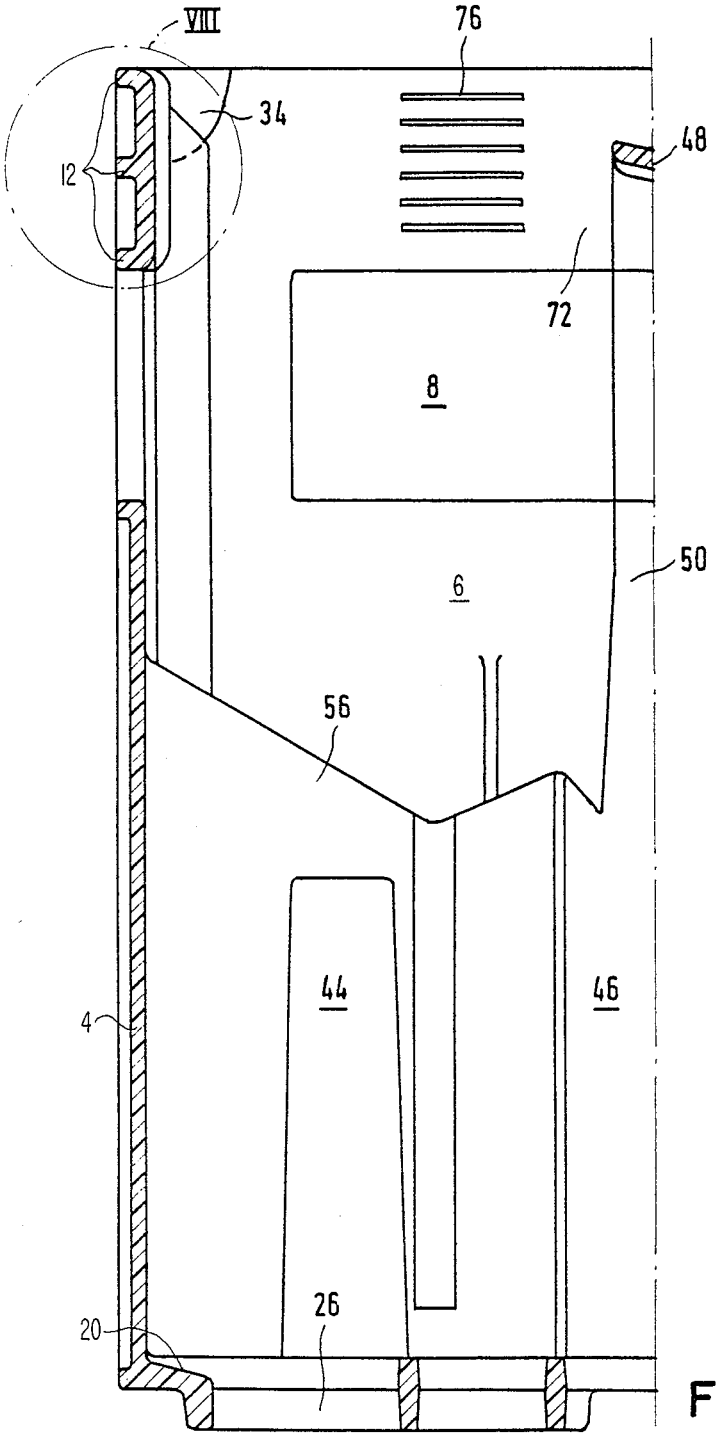
FIG. 4 is a partial end elevation in partial transverse section along line 4—4 of FIG. 1.

The bottle case 2 shown from the outside in the FIGS. 1 and 2 has two essentially closed side walls 4 and two essentially closed front walls 6 which are each broken in their upper region only by a transversely extending handgrip slot 8. Below each of the handgrip slots 8 there is provided a smooth advertising wall panel. In the lower region of the bottle case and immediately under the handgrip slot and over the handgrip extend numerous horizontal wall reinforcement ribs 12, which merge into reinforced hollow column-like case corners 14. The horizontal wall reinforcement ribs can be further strengthened by additional vertical wall reinforcement ribs 16. On the outer side of the case corners 14 are formed rib profile groups 18 which are mutually displaced and which for clamp palletizing assure the holding together of two adjacent bottle cases.

About a supporting rim 20, which runs completely about the bottle case, and set back toward the inside is a bottom support rib network 22 of the bottle case 2 which protrudes down the distance that the bottle case extends into the second bottle case located under it and on which the case 2 rests when on the ground. This protruding region of the bottom support rib arrangement is divided into individual support sections 26 by longitudinal and lateral extending channel-like recesses 24. The channel-like recesses 24 have the same depth as the distance that the bottle case extends into the second bottle case located under it.

The length to width ratio of the bottle case 2 is 3:2. Accordingly, perpendicular to the side walls there are two channel-like recesses 24. Accordingly along the side walls the bottom rib arrangement 22 is divided into three individual sections 26 and along the front side into two.

The channel-like recesses run in a straight line parallel to the longitudinal and to the lateral directions of the bottle case.

Figure 6:
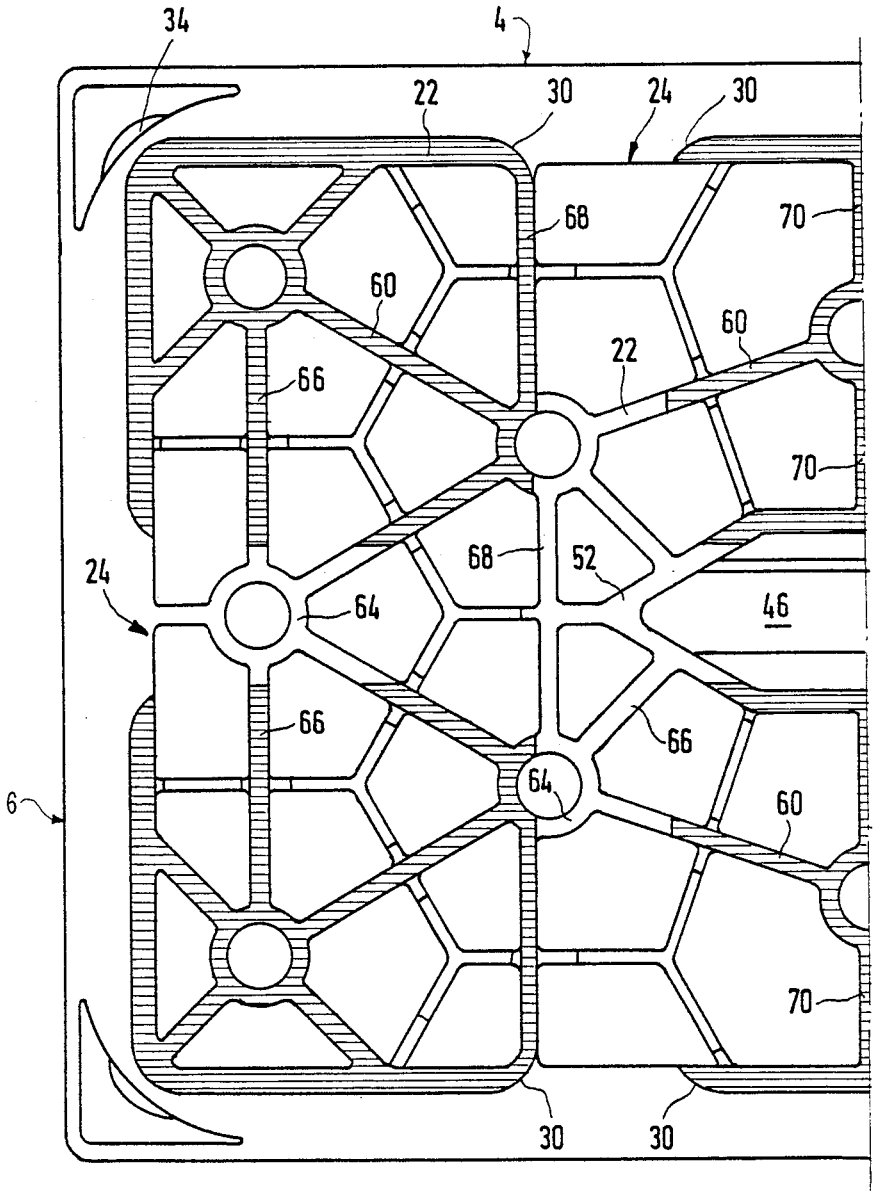
FIG. 6 is a partial bottom plan view of the case of FIGS. 1–5.
Figure 7:
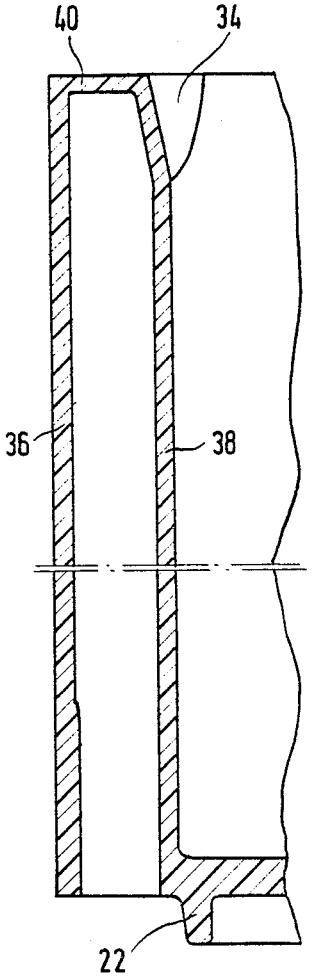
FIG. 7 is a fragmentary sectional view along line VII—VII of FIG. 4.
Figure 9:
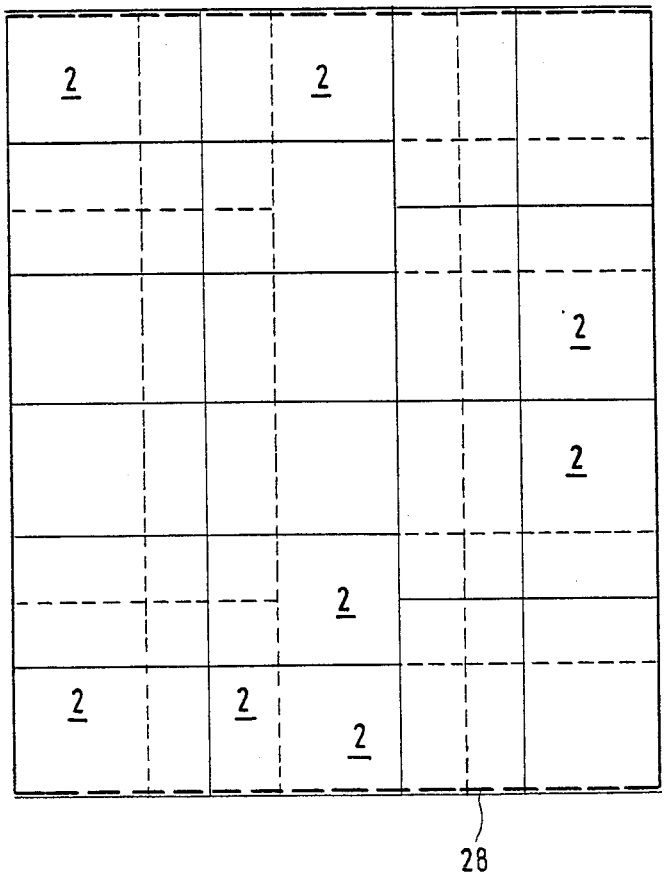
FIG. 9 is a diagrammatic plan view of a plurality of bottle cases according to FIGS. 1–8, showing two layers thereof as they can be arranged on a pallet.
Figure 10:
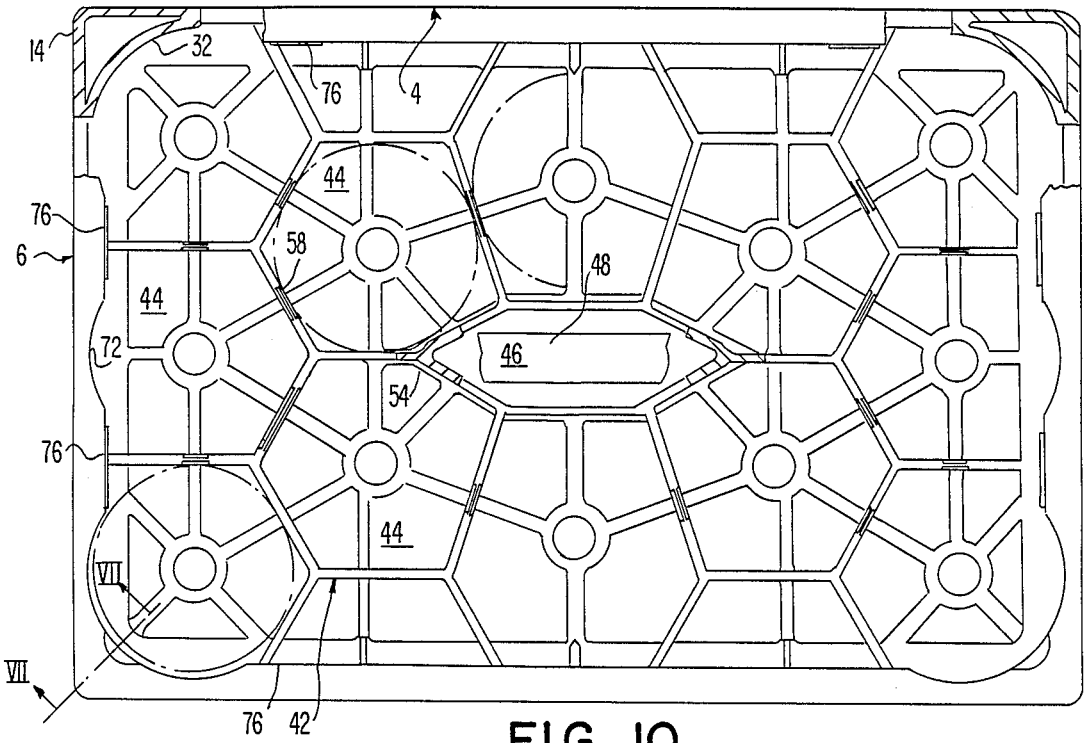
FIG. 10 is a full top plan view, in partial section, of the bottle cae of FIGS. 1–4.
Figure 11:
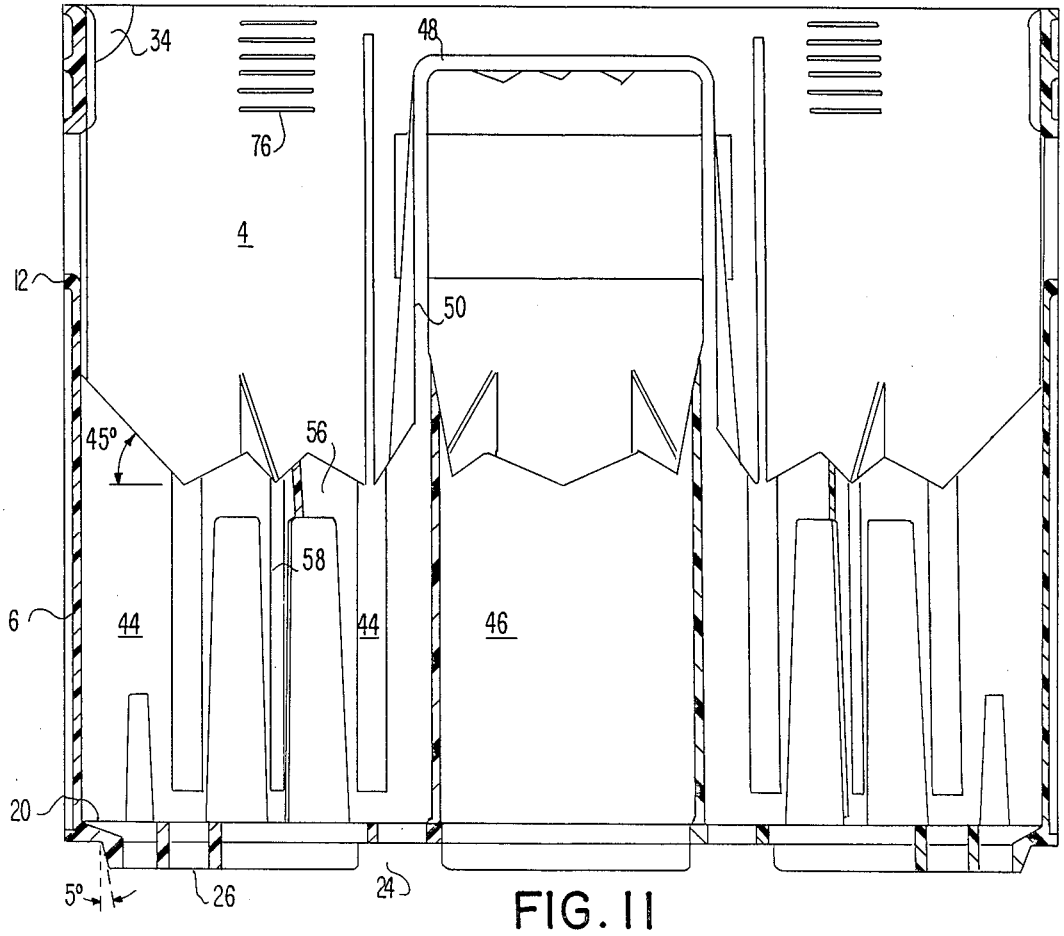
FIG. 11 is a full side elevational view, in partial section, of the bottle case of FIGS. 1–4.

This division into sections of the bottom support rib arrangement 22 makes possible the staggered stacking of the bottle case 2 on a pallet 28 as illustrated in broken lines in FIG. 9. The second layer of bottle cases 2 in the staggered stacking arrangement is indicated in FIG. 9 in broken lines. It can be seen that thereby in one layer the bottle cases are transverse to the bottle cases of the other layer, so that only some of the individual sections 26 extend into the bottle cases thereunder. This also has the consequence that corners 30 of the individual sections 26 which are not at the corners of the bottle case extend into the inner corner region of a bottle case thereunder. The corners 30 are sharply curved with a relatively small radius of curvature (FIG. 6). As can otherwise be seen from FIG. 5, the inner corner wall regions 32 at the inner surface of the bottle case can be rounded with a relatively large radius of curvature. In these inner wall regions 32 at the upper bottle case rim in each rounded corner there is a corner recess which is recessed at least as far as the depth to which one bottle case extends into a bottle case below it and which always has a smaller radius of curvature than the inner wall corner region 32. In staggered stacking, the relatively sharp corners 30 of the individual sections 26 of the bottom support rib network 22 fit into these recesses. In FIG. 7 there is illustrated in enlarged form the double wall corner structure with an outer wall 36 and an inner wall 38 with substantially constant wall thickness. It can be seen that the recess 34 is formed simply by the corresponding setting back of the inner wall. At the upper edge of the bottle case the outer wall and inner wall are connected to each other by a vertical bridge.

Figure 5:
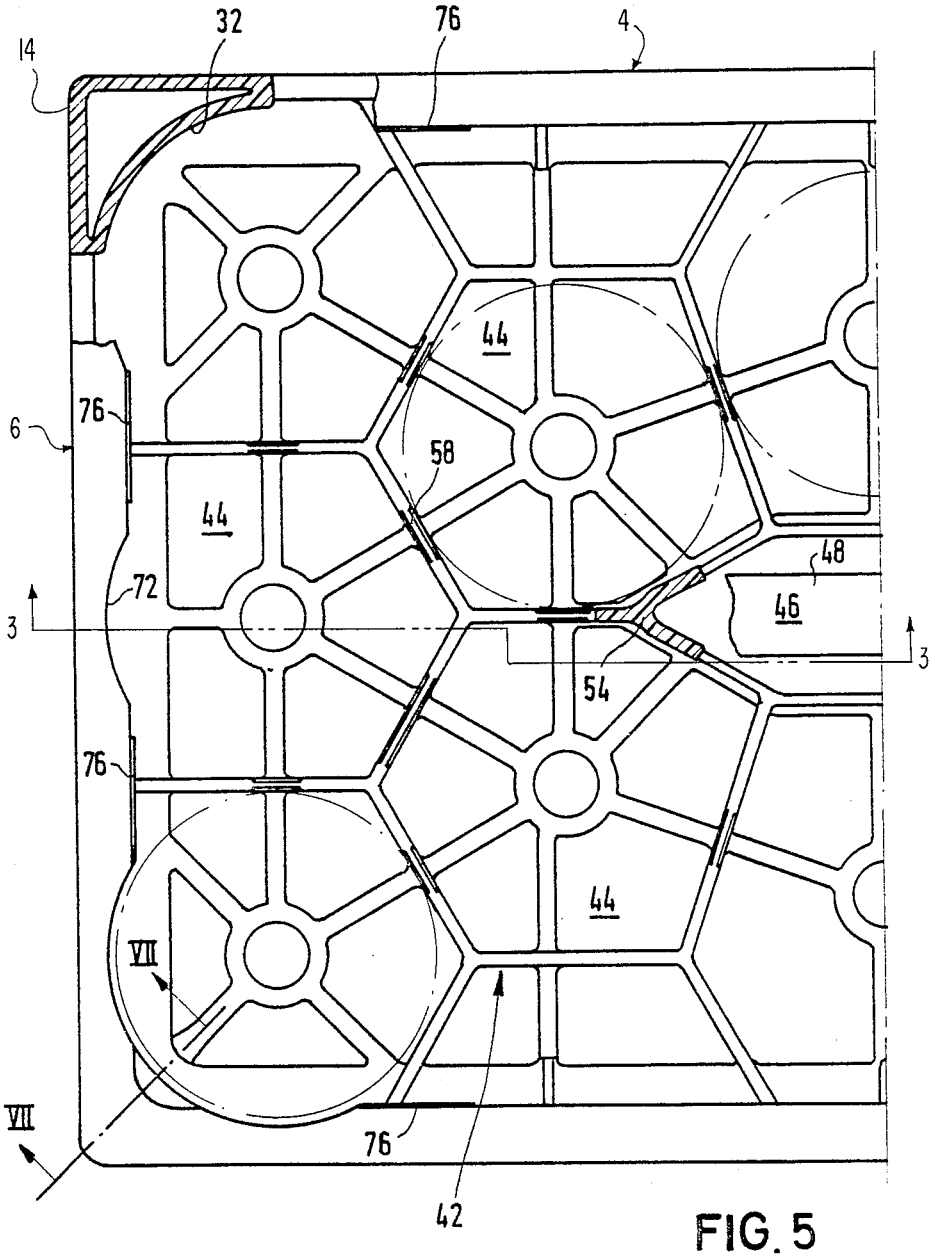
FIG. 5 is a partial top plan view, in partial section, of the bottle case of FIGS. 1–4, partially broken away.

As can be seen especially from FIG. 5, the bottle case 2 is provided with a compartmenting 42. This divides the inner space into compartments and extends to a portion of the total height of the bottle case corresponding to the height of the thicker portion of a bottle. There are provided compartments 44 for receiving bottles and a central compartment 46 which is bridged by a bow-shaped handle 48.

The compartmenting 42 is integrally connected with the bottom support rib arrangement 22, the side and front walls 4 and 6, and the handle 48 all of which are injection molded together in one piece. Especially useful for this is thermoplastic synthetic, preferably polyethylene or polypropelene.

In accordance with FIGS. 5 and 6, the individual compartments running in compartment rows parallel to the front walls 6 are displaced with respect to each other so as to fill gaps, and in such a way that bordering on each of the front sides there are three compartments 44 for receiving bottles. In the adjacent row of each there follow two compartments 44 for receiving bottles. There is connected between them a middle row with three compartments, of which the middle compartment forms the central compartment 46 and the two outer compartments again are compartments 44 for receving bottles. Thereby there are compartments 44 for receiving bottles arranged all the way around the central compartment 46, and there are provided altogether twelve compartments 44 for receiving bottles. Further evennumbered groups of compartments 44 for varied arrangements can amount to 6, 10, 12, 20, 24, or 30, or the like. Common uneven numbers of bottles in bottle cases are, for example, 15 or 25.

The compartments 44 for receiving bottles, as well as the central compartment, all have essentially a honeycomb configuration, which here is hexagonal except for the two outer rows at the front sides, where there is a flattening of the hexagonal form by the front walls.

The central compartment 46 is smaller in the direction of the width of the bottle case than are the compartments 44 for receiving bottles, but is nevertheless longer as measured in the lengthwise direction of the bottle case. One can see from the FIGS. 5 and 6 that through this the compartments 44 for receiving bottles can be grouped even closer to the central compartment 46.

Having the bottle-receiving compartments in the vicinity of the central handle spaced from the side wall of the case brings with it an important advantage. In the machine handling of such cases there are generally used gripper tongs which have one arm of a tong reaching over the side wall of the case between the case wall and the bottles. Where the bottles are immediately adjacent the side wall, there is very little clearance for such grippers. Therefore, it is common to locate any reinforcing ribs for the wall handle above the handle slot in the side wall on the outside of the case. This has the disadvantage that, partly for reasons of molding procedures for such a shape, the advertising panel of the side wall must be inset in the case and the total space in the case interior is thus reduced. Spacing of the compartments a distance away from the inside surface of the side wall, on the other hand, makes it possible to provide some necessary reinforcement contour features for the side wall on the inside of the side wall. This increases the total space inside the case, improves the outward appearance by eliminating structural detail, and makes it possible to have the side wall advertising panel nearly flush with the other exterior features of the case. The latter advantage is a result largely of the added possibilities that such a design permits in the molding process for the case.

It is particularly advantageous for the wall handle above the handle slot in the side wall of the case to have its surface facing the inside of the case contoured cylindrically concave along the length of the side wall handle. That is, with the cylindrical axis of the concave contour running parallel to the side wall handle. This contouring has the effect of reinforcing the handle against sideways pressure toward the inside of the case, as occurs in clamp palletizing, and also at the same time provides a gripping surface for the gripping tongs of a mechanical handling apparatus which prevents that element of the tongs which reaches inside the case wall from slipping off the handle. A similar concave contour can also be provided for the end wall handles.

Supporting shanks 50 extend upward as an extension of the intersection divider wall regions 52 at each end of the central compartment 46 in the longitudinal. The central compartment 46 is mirror-symmetrical both in the longitudinal and the transverse lateral direction. According to the compartmenting 42, the support shanks have three ribs 54 which are oriented to each other in a y-shape and taper from the bottom to the top to provide sufficient resistance to kinking. The handle, which may have hand-fitting profile, extends over a portion of the width of the central compartment and approximately over its length.

The construction of the shanks of the handle is an important feature of the case, for it greatly facilitates the loading of bottles into the case by means of automatic machinery. The type of machinery commonly used for loading bottles into cases performs this function with great speed, and actually more or less drops the bottles into the compartment as soon as they are somewhat aligned with them. Since alignment is not always perfect, and since there may be some relative movement between case and bottles at the moment the bottles are dropped, the bottom edge of the bottles frequently can strike against compartment edges or other shoulder surfaces in the case and thus prevent proper loading. However, with the handle shanks constructed in accordance with the present invention so that they are extensions of the compartmenting walls, the bottles are guided against the surfaces of the shanks directly into the compartments of which they form a part of the defining wall. As a result, the shanks for the handle do not require any space for themselves in the case beyond what the compartmenting itself would require without the shanks, since they are merely extensions of the compartmenting. Furthermore, at the same time that the shanks support the handle over the central compartment, they also provide effective guides for the bottles and do not themselves present any shoulders for the bottoms of the bottles to strike against.

While the central compartment 46 is open at the bottom, the compartments 44 for receiving bottles are partially closed by the bottom rib arrangement 22, so that a bottle placed in one of the individual compartments 44 for receiving bottles cannot fall through.

The compartments 44 thereby features at the upper end of each compartment surrounding honeycomb-shaped dividers 56 bordering the compartment and which are only at various points connected by vertical hanging straps with the support ribs 60 of the bottom support rib network.

Centrally situated in the bottom support rib arrangement 22 under and in the center of each of the compartments 44 for receiving bottles is a ring support rib 64 for central support of a received bottle. Star-shaped individual support ribs 60 of the bottom support rib arrangement extend outward from these and are thereby connected together jointly and with the side and front walls 4 and 6 of the bottle case. Thereby a portion of the ribs 60 and in zig-zag form between the oppositely situated side and end walls. Additionally provided are special bottom support ribs which run essentially parallel to the end walls 6 and essentially straight between the side walls 4 of the bottle case and are profiled so that there is sufficient rigidity to counter the compression of the bottle case in clamp palletizing. One bottom support rib 66 runs along through the middle region of each of the sections 26 lying to the side of the central compartment 46, and does so somewhat closer to the end walls 6 than to the inner located channel-like recesses 24. There each is provided with a further bottom support rib 68, which, at the side, borders at the edge of the last-named channel-like recesses 24. The edge support ribs 68 run essentially straight, while the middle support ribs 66 branch in a Y-form into the side wall in the neighborhood of the side walls 4. Alternatively there could be provided other support ribs 68 somewhat stronger, but at the same time somewhat lower, which are not shown and which would run directly into the bottom of the channel-like recesses 24 in the bottom support network.

Finally, there is provided a further central bottom support rib 70, which extends to both sides of the central compartment 46 and for which the central compartment 46 serves as resilient element. The support ribs 66 and 68 are arranged in mirror symmetry to the central support rib 70 and are distributed over the length of the bottle case in accordance with the expected loading in clamp palletizing. The central support rib 70 does not extend within the central compartment 46, but rather runs in two parallel branches around its boundaries.

Figure 8:
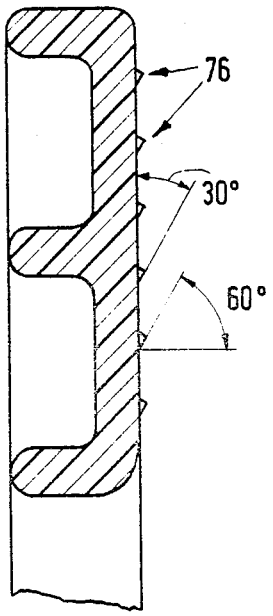
FIG. 8 is an enlarged partial sectional view of the region VIII of FIG. 4.

The inner surface of the bottle case walls, which is formed by the bottle case walls 4 and 6, is provided over large regions, especially in the bottle case corners and bordering the compartments 44 for receiving bottles, with rounded recesses which are essentially adapted to the contour of a bottle to be received. Aside from the corner regions with their rounded inner wall regions 32, there are provided in addition contours 72 which on the outer side of the bottle case present correspondingly rounded outward bulges 74. Accordingly, there are left only few substantially straight regions in the upper inner wall surface of the bottle case. These are arranged at each inner surface of the side wall 4 and on the inner surface of the end wall 6 at two locations which are in mirror symmetry to the longitudinal and transverse axes of the bottle case. These are each provided with a profiled contact surface 76 for cooperating with graspers of a transporting device which reach over the bottle case wall. The design of these contact surfaces is shown enlarged in the FIG. 8. It can be recognized that in this embodiment there are provided horizontal beads with triangular configuration spaced vertically and which have angles, for example, of suitably 60 degrees to horizontal and 30 degrees to vertical.

I claim:

1. A molded stackable bottle case, comprising:

two opposing end walls spaced from each other and having upper and having upper and bottom edges;

two opposing side walls which are longer than said end walls and connected thereto at ends thereof, and having upper and bottom edges;

a network of supporting ribs extending transversely from and connecting said bottom edges of said end and side walls to form a bottom for the case;

a latticework of interconnected compartment walls connected to inside surfaces of said end and side walls and said supporting ribs, said compartment walls subdividing the case to form a plurality of individual bottle receiving compartments and an elongated central compartment having longitudinal ends;

three support members extending vertically upwardly from three of said compartment walls which are adjacent said longitudinal ends of said central compartment, each of said support members being coplanar and unitarily formed with its associated compartment wall, said support members tapering from ends thereof adjacent said compartment walls to distal ends; and a central carrying handle disposed over said central compartment and coupled to said distal ends of said support members, wherein said supporting ribs have portions thereof which extend below said bottom edges of said end and side walls with said bottom edges forming support shoulders; said portions of said supporting ribs are divided by channels into equal rectangular sections having bottom section corners with a radius of curvature substantially smaller than that of bottles to be received in said receiving compartments and said end and side walls are joined at corners of double wall construction, a corner depression is provided on an inner surface of each said corner and has a radius of curvature substantially less than that of bottles to be received in said receiving compartments and matching said radius of curvature of said bottom section corners, said depressions having a depth at least as great as the extent said supporting rib portions extend below said bottom edges of said end and side walls.

2. A molded stackable bottle case, comprising:

two opposing end walls spaced from each other and having upper and bottom edges;

two opposing side walls which are longer than said end walls and connected thereto at ends thereof, and having upper and bottom edges;

a network of supporting ribs extending transversely from and connecting said bottom edges of said end and side walls to form a bottom for the case;

a latticework of interconnected compartment walls connected to inside surfaces of said end and side walls and said supporting ribs, said compartment walls subdividing the case to form a plurality of individual bottle receiving compartments and an elongated central compartment having longitudinal ends;

three support members extending vertically upwardly from three of said compartment walls which are adjacent said longitudinal ends of said central compartment, each of said support members being coplanar and unitarily formed with its associated compartment wall, said support members tapering from ends thereof adjacent said compartment walls to distal ends; and a central carrying handle disposed over said central compartment and coupled to said distal ends of said support members;

all of said compartment walls being parallel to or oriented at an acute angle relative to said side walls;

said network including transverse ribs extending between said side walls to provide reinforcement against compression thereof, said ribs having portions thereof which extend below said bottom edges with said bottom edges forming support shoulders, and channels dividing said portions into rectangular sections, some of said transverse ribs extending adjacent said channels;

whereby, when the case is placed in alignment on top of a similarly constructed supporting case, said portions extend into a top opening in the supporting case to retain the case in alignment, said receiving compartments being hexagonal and arranged in a honeycomb pattern, wherein a set of three of said support members are provided at each of said longitudinal ends of said central compartment, each set of three support members extend from a set of three compartment walls which are oriented relative to each other in a Y-shape.

3. A molded, stackable bottle case, comprising two opposing end walls spaced from each other and having upper and bottom edges;

two opposing side walls which are longer than said end walls and connected thereto at ends thereof, and having upper and bottom edges;

a latticework of interconnected compartment walls connected to inside surfaces of said end and side walls, said compartment walls subdividing the case to form a plurality of individual bottle receiving compartments and an elongated central compartment having longitudinal ends; and a network of supporting ribs extending transversely from and connecting said bottom edges of said end and side walls to form a bottom for the case, said supporting ribs having portions thereof which extend below said bottom edges of said end and side walls with said bottom edges forming support shoulders, said portions of said supporting ribs being divided by channels into equal rectangular sections having bottom section corners with a radius of curvature substantially smaller than that of bottles to be received in said receiving compartments, and said end and side walls are joined at corners of double wall construction, a corner depression being provided on an inner surface of each said corner and having a radius of curvature substantially less than that of bottles to be received in said receiving compartments and matching said radius of curvature of said bottom section corners, said depressions having a depth at least as great as the extent said supporting rib portions extend below said bottom edges of said end and side walls.

* * * * *